US005899371A

United States Patent [19]

Weliver

[11] Patent Number: 5,899,371

[45] Date of Patent: May 4, 1999

[54] GOLF PACK FOR VALUABLES

[75] Inventor: William W. Weliver, LaPorte, Ind.

[73] Assignee: Par 4 Enterprises, Inc., LaPorte, Ind.

[21] Appl. No.: 09/030,857

[22] Filed: Feb. 26, 1998

[51] Int. Cl.[6] ..... A45F 5/00

[52] U.S. Cl. ..... 224/245; 224/918; 224/666; 224/668; 224/681; 224/683; 224/684; 206/5; 206/315.5; 248/902; 150/112; 150/119

[58] Field of Search ..... 224/676, 677, 224/680, 681, 682, 683, 684, 235, 236, 666, 668, 242, 245, 652, 654, 655, 657, 250, 223, 918; D3/224, 225, 226, 230; 248/902; 206/5, 6, 315.5; 24/3.3; 190/102; 150/112, 119

[56] References Cited

U.S. PATENT DOCUMENTS

| | | | |
|---|---|---|---|
| D. 292,843 | 11/1987 | Frezza | 224/223 X |
| D. 332,176 | 1/1993 | Mueller | 224/223 X |
| 1,625,920 | 4/1927 | Thuman | 224/666 X |
| 1,648,565 | 11/1927 | Primley | 224/681 X |
| 4,151,937 | 5/1979 | Jarosh et al. . | |
| 4,449,310 | 5/1984 | Kline . | |
| 4,730,728 | 3/1988 | Larkin . | |
| 4,736,877 | 4/1988 | Clark . | |
| 4,917,160 | 4/1990 | Hart et al. | 224/681 X |
| 4,984,682 | 1/1991 | Cummins | 206/5 |
| 5,031,812 | 7/1991 | Gustine . | |
| 5,176,253 | 1/1993 | Perrin et al. . | |
| 5,209,385 | 5/1993 | Ledesma | 224/223 X |
| 5,706,935 | 1/1998 | Lorton | 206/5 X |

FOREIGN PATENT DOCUMENTS

| | | | |
|---|---|---|---|
| 168752 | 2/1950 | Germany | 206/5 |

*Primary Examiner*—Allan N. Shoap
*Assistant Examiner*—Gregory M. Vidovich
*Attorney, Agent, or Firm*—Donald C. Casey, Esq.

[57] ABSTRACT

A pack for carrying valuables and golf accessories by a golfer is described. The pack includes a pouch having a zippered closure for retaining non-golf accessories such as keys, change, glasses, and the like and an external pocket for retaining golf accessories during play. The pouch is elongated and concave with a rigid backing material having an integral clip thereon for affixing the pouch to the wearer's belt or to the golf bag. The pack is intended to make the golf accessories readily available during play while securing the golfer's valuables and to be easily removable from the golf bag after play so that the valuables can be maintained on the golfer's person.

5 Claims, 3 Drawing Sheets

GOLF PACK FOR VALUABLES

FIELD OF THE INVENTION

This invention relates to golf accessories and particular to a field pack for personal valuables which can be worn by the golfer or attached to the golf bag.

DESCRIPTION OF THE PRIOR ART

In the game of golf, the golfer has a number of accessories which must be carried during play such as tees, ball markers, spare golf balls, and the like. There are a wide variety of carriers which have been devised for such items and which are limited to use with such items. The standard golf bag has at least one external pouch for golf balls, but does not provide for other security.

In the U.S. Pat. No. 4,151,937 there is provided a plastic case which is rectangular in cross section and which has an aperture for mounting a ball marker, apertures for mounting tees, and has a divot replacement forked device extending from an end thereof. The case, being rigid, functions as a handle for the divot replacement tool, and is provided with a clip for attachment to the golfer's belt. Similarly, in U.S. Pat. No. 4,730,728, a rigid cylindrical member is provided which houses golf balls, and is provided with a flange surrounding the cylindrical golf ball housing for mounting spare tees, markers, a pencil and the like. This device also includes a plastic loop so that it can be either suspended from the golfer's belt or from the golf bag.

These devices as described in the above patents are special purpose carriers for golf accessories, and do not provide for personal items typically carried by the golfer, such as sunglasses, change, keys and the like. As is well known, golf attire may come with pockets but it is not always desirable to carry bulky items such as car and locker keys, change, glasses, and the like in pockets as these items can prove to be uncomfortable during play. Some golfing attire is not sufficiently loose fitting to carry these items comfortably in pockets, and still other types of golfing attire may not have pockets at all.

Certain other types of devices for carrying golf accessories which are belt mounted are shown for example U.S. Pat. Nos. 4,736,877 and 5,031,812. In the first of such patents the accessory holder is a rectangular metal plate using magnets, rivets and the like. This device is also not intended to hold non-golf related accessory items, and because it is metal it could rust. It is comparably expensive relative to plastic or the like.

In the U.S. Pat. No. 5,031,812, there is described a pouch member which is mounted on the golfer's belt. The pouch is described as designed to carry keys and spare golf balls. A ball marker is intended to be affixed directly to a belt mounted Velcro strip. The Velcro strip is provided as an integral portion of the golfer's belt. Velcro is the only means provided for attaching the pouch to the wearer.

These devices clearly are intended to be worn on the person of the golfer and are not interchangeable or mountable on the golf bag. In addition, when the means for attachment is Velcro, as is obvious to those skilled in the art, over time this attachment means can become frayed, filled dust or debris, and the like.

A golf bag mounted accessory holder is also described in U.S. Pat. No. 4,449,310. This device is a clip only, and is designed to hold a pencil and score card. There is no feature described for attachment to the person of the golfer if desired.

There is a need then for a device which may be carried by the golfer as desired or affixed to the golf bag which will not only hold golf accessories readily available but also will hold the valuables of the golfer in a secure manner. Typically, the valuables would be deposited in such a device and it would be affixed to the golf bag while play proceeds. If the golfer decides to suspend play or at the finish of the round, the golf bag may be left in a cart, deposited in the locker room, or the like, and the valuables kept with the golfer as the accessory container is detached from the bag. In this way, the valuables can be within the control of the golfer at all times.

In U.S. Pat. No. 5,176,253 there is provided a golf bag which has a zippered pocket which receives an carrying pouch which can be detached from the bag and carried around the waist of the user. This pouch is similar to a conventional bag which is waist mounted on a belt so that the coupling for the belt can be released to release the bag from the wearer. This device however requires a special purpose golf bag in that it is normally mounted in its own zippered pouch on the side of the bag and integral therewith. It would not be feasible then for this device to be used by golfers unless they are prepared to purchase a special type of golf bag.

Accordingly then, there does not exist a special purpose carrying pouch which can be carried either on the golfer's bag or on the golfer's person for golf accessories or personal valuables.

SUMMARY OF THE INVENTION

It has been discovered that a versatile pack for carrying valuables as well as golf accessories can be provided which will solve the above problems as presented by the prior art. The device of this invention utilizes a soft outer covering of canvas or the like which is supported on a narrow backing of relatively rigid material which has an integral external clip for attachment to the wearer's belt or the golf bag. The bag is soft so that the pack of the this invention will be relatively comfortable to wear. The wearer can retain conventional eyeglasses in the pouch of this invention while sunglasses are worn to play golf and interchange them if desired. In any event the spare glasses would be secured by a strap mount within the pouch against the rigid backing.

In addition, the pouch is closed by a zippered flap so that articles stored therein will be securely retained. The sides of the pouch however mount loops or open stitched compartments to receive pencils, scorecards or presumably golf tees and other golf accessories. The interior of the pouch is intended to mount a conventional eyeglass holder integral with the backing so that eyeglasses can be stored within the pouch against scratching or the like if the pouch is jostled.

Accordingly, it is the object of this invention to provide a pack for valuables, golf accessories, or the like which can be worn by the golfer or removably affixed to the golfer's bag so that the contents are under the golfer's control at all times.

It is another object of this invention to provide a pack for carrying valuables which utilizes a soft canvas or other type of outer covering supported by a rigid backing which carries an external clip for attachment of the bag either to the wearer's belt or to the golfer's bag.

It is still another object of this invention or provide a soft pouch which can be comfortably worn or mounted on a golf bag which is supported by a narrow backing but is otherwise a soft pouch for containing items and which further provides a mounting on the backing for eyeglasses.

It is still another object of this invention to provide a pack for valuables which can be either worn by a golfer during play and which can be mounted on the golf bag and which is readily removable, and which incorporates a soft pouch with a zippered closure and external slots or loops for containing pencils, golf tees, score cards, and other similar golf accessories so that the golf accessories are readily available to the golf without opening the zippered closure and the valuables will be retained in the pouch against loss by the zippered closure.

These and other objects will become readily apparent with reference to the drawings and following description:

DETAILED DESCRIPTION OF THE INVENTION

Figure 1:
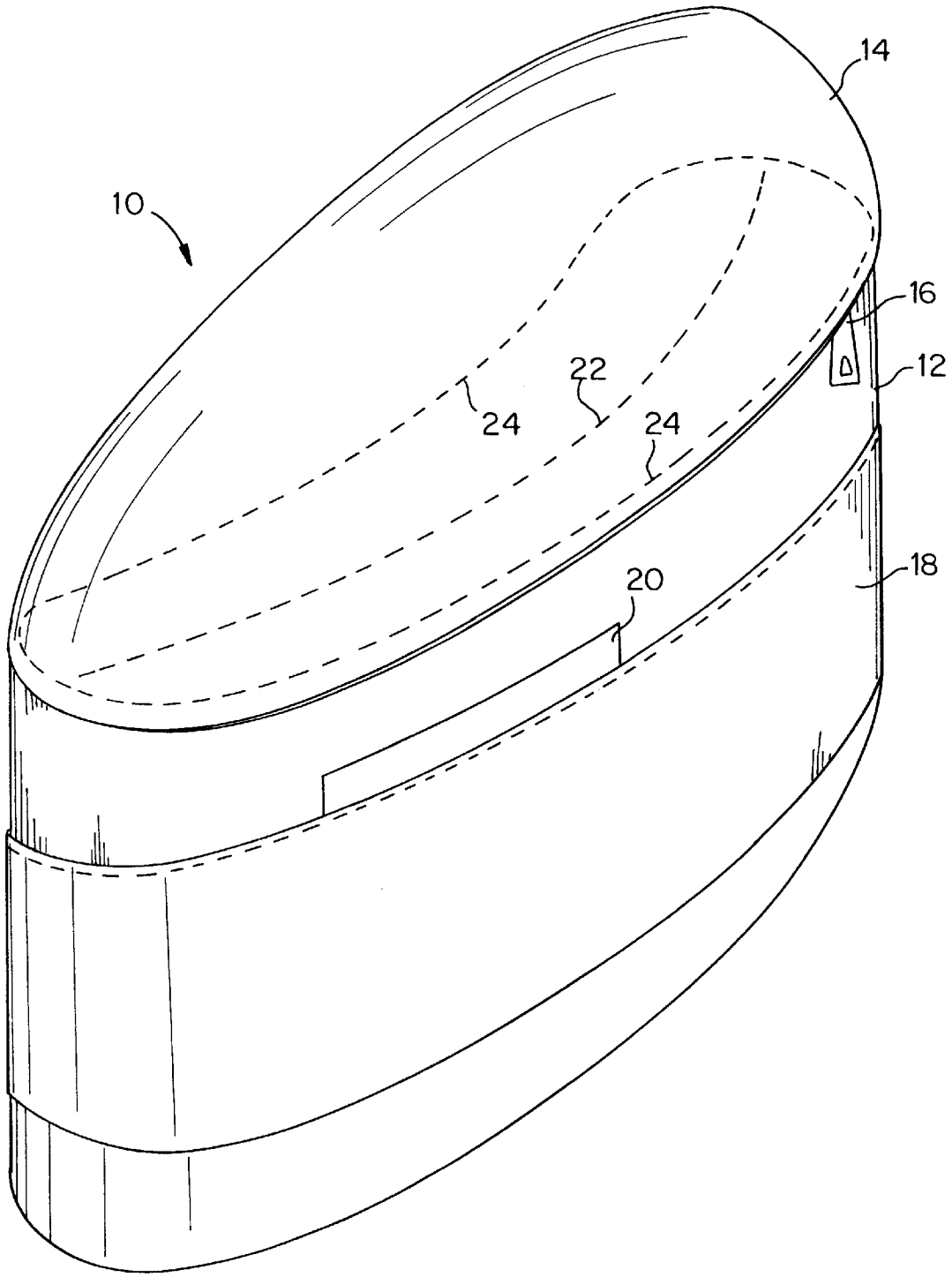
FIG. 1 is a front perspective view of the pack of this invention.

The device of this invention 10 consists of a pouch 12 with a top 14 and a zippered closure 16 therefore. An external pocket 18 surrounds the front portion of the pouch 12 and can be used to mount for example a score card 20 therein. The pouch of this invention and the zippered lid are preferably of soft construction such as canvas, vinyl or the like. The pocket 18 is preferably of the same material as the pouch 12 and the lid 14. If desired the device 10 can be constructed of waterproof material and this invention is not meant to be limited to the type of construction material used to form the pack 10.

The interior of the pouch 12 is preferably divided by walls 22. The interior divider 22 may separate a liner having inner and outer walls 24. The liner walls 24 may or not be of the same material as the inner wall 22 or for that matter the pouch 12. It is intended however that the divider 22, liner 24, pouch 12 and lid 14 therefore are of relatively soft material.

Figure 2:
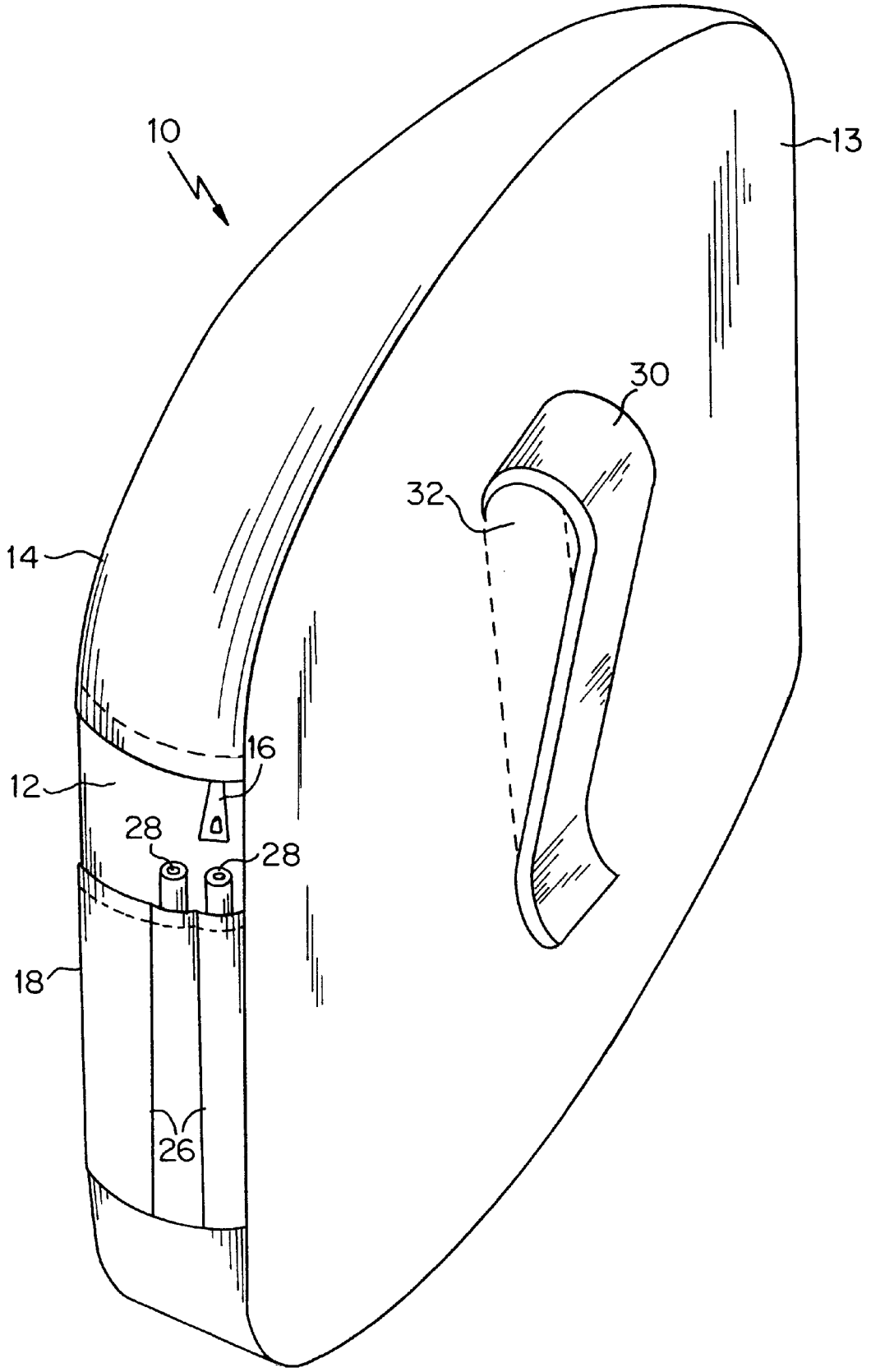
FIG. 2 is a rear perspective view of the pack of this invention.

With attention to FIG. 2, the pocket 18 which surrounds the outer portion of pouch 12 can be provided with loops or vertical pockets to receive accessories. Pencils 28 are shown but as will be obvious to those skilled in the art, golf tees, divot replacement tools, ball markers, or the like (not shown), could be retained in the pocket 18. The back 13 of the device 10 mounts an exposed clip 30. Clip 30 is preferably of plastic material. The clip is integral with a rigid backing material 32 which is affixed to the back wall 13 of the device.

Figure 3:
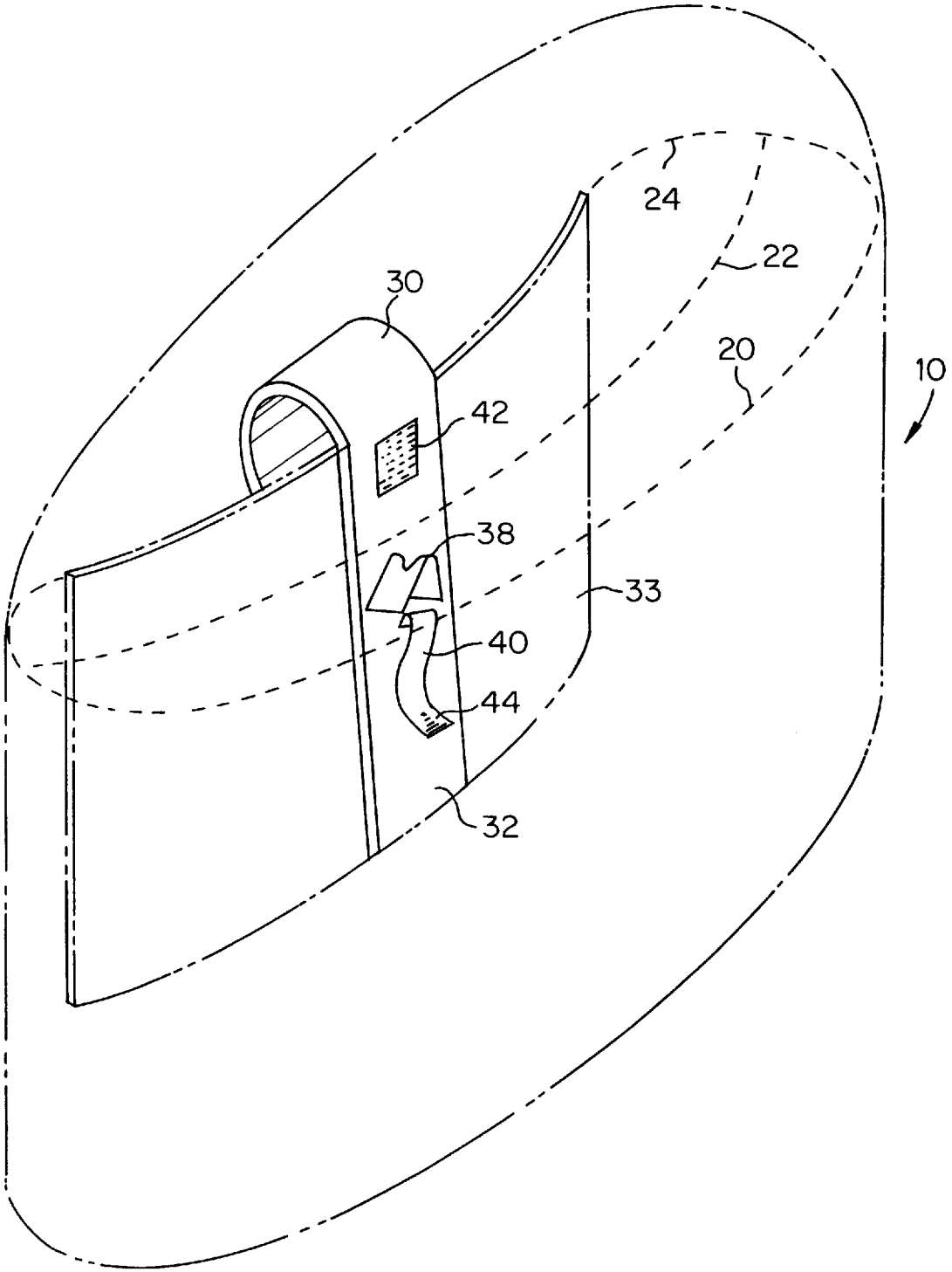
FIG. 3 is a front perspective view of the backing portion of the pack of this invention with the external configuration thereof and an alternative embodiment shown in phantom.

As shown in FIG. 3, the interior of pouch 10 may provide as an alternative embodiment a rigid backing material 33 and centrally thereof is provided an eyeglass holder 38 with the flexible strip 40 for retaining a pair of eyeglasses in the convention manner. A Velcro (hook and loop fastener) strip is provided for use with the end 44 of strip 40 for retaining the glasses in the conventional manner on the holder 38. In the preferred embodiment holder 38 would not be provided but strip 40 would retain glasses on backing 32.

Whereas the pouch 10 itself is of soft material then the eyeglasses will be retained against movement by the backing material 32 which is preferably a plastic material, the same as that forming the clip 30. The pouch 10 is elongated, as is backing 32 and has arcuate configuration in the longitudinal direction as it takes configuration of the arcuate backing 32.

The golfer's valuables, such as car keys, locker keys, cash, wristwatch, eyeglasses, sunglasses, or the like can then be deposited within pouch 10 and the lid 14 secured by zipper 16. The golf accessories are stored externally to the pouch in pocket 18 so that during play the golfer will not need to enter the pouch unless it is necessary for example to exchange e sunglasses for eyeglasses. The score card, pencil, ball marker, tees and the like are all retained in the pocket 18 external to the pouch 10.

When play is ongoing the pouch 10 can be affixed by clip 30 to the golf bag where it will be readily accessible to the golfer. When play is completed the golf bag can be deposited in the locker room and the pouch 10 removed and affixed to the golfer's belt so t at valuables are within the golfer's control while the golf clubs are not in use. Therefore the device of this invention provides multiple functions both protecting the golfer's valuables and providing a convenient carrier for golf accessories making them readily available during play. By providing a soft pouch the device is more comfortable to wear, and the rigid backing material the ein provides the support for the clip.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only the definition contained in the appended claims and equivalents thereof.

What is claimed:

1. A pack for carrying golf accessory items and non-golf personal valuables comprising:

a laterally elongated, soft pouch, opening upwardly and having a front, back, sides and a bottom, wherein upper edges of sides front, back, and sides define an upper opening;

an external pocket carried by the pouch surrounding the sides and front;

a lid carried by the pouch over the opening therein and releasable closure means for closing said lid over said opening;

a backing member mounted in said pouch extending from th upper opening downwardly toward the bottom, said backing member being concave with an inner concave surface secured to the back of said pouch integral clip member extending along the back, outside of said pouch, registering with said backing member; and means for mounting eyeglasses carried by said backing member within said pouch.

2. The pack of claim 1 further comprising at least one interior pocket disposed in said pouch opening upwardly and constructed of soft material.

3. The pack of claim 2 wherein said lid has front, back, and side edges, the back edge of side lid being integral with said pouch and the front and side edges registering with the opening of said pouch.

4. The pack of claim 3 wherein said closure means is a zipper connecting the front and side edges of said lid with said pouch opening.

5. The pack of claim 2 wherein said means for mounting eyeglasses includes a flexible strip carried by said backing member extending into said pouch for retaining glasses thereon.

* * * * *